US007367469B2

(12) United States Patent
Lipson

(10) Patent No.: US 7,367,469 B2
(45) Date of Patent: May 6, 2008

(54) DRINK CONTAINER WITH MOLDED STRAW AND METHOD OF MANUFACTURE

(76) Inventor: Erik Lipson, 530 S. Second St. GU-11, Philadelphia, PA (US) 19147

( * ) Notice: Subject to any disclaimer, the term of this patent is extended or adjusted under 35 U.S.C. 154(b) by 0 days.

(21) Appl. No.: 11/290,241

(22) Filed: Nov. 30, 2005

(65) Prior Publication Data

US 2006/0157490 A1 Jul. 20, 2006

Related U.S. Application Data

(63) Continuation of application No. 10/022,755, filed on Dec. 13, 2001, now Pat. No. 7,021,490, which is a continuation of application No. 09/431,492, filed on Nov. 2, 1999, now Pat. No. 6,336,566.

(60) Provisional application No. 60/119,875, filed on Feb. 12, 1999, provisional application No. 60/107,419, filed on Nov. 6, 1998.

(51) Int. Cl.
*A47G 19/22* (2006.01)

(52) U.S. Cl. ..... 220/710

(58) Field of Classification Search ..... None
See application file for complete search history.

(56) References Cited

U.S. PATENT DOCUMENTS

| | | | | |
|---|---|---|---|---|
| 3,171,573 | A * | 3/1965 | Berney | 222/183 |
| 3,980,210 | A * | 9/1976 | Kligerman | 222/456 |
| 4,191,302 | A | 3/1980 | Fiducia | 220/1 |
| 4,318,403 | A * | 3/1982 | Sneider | 604/2 |
| D269,659 | S | 7/1983 | Holloway | D7/11 |
| 4,428,490 | A | 1/1984 | Holloway | 215/1 |
| D279,250 | S | 6/1985 | Holloway | D7/6 |
| 5,078,286 | A | 1/1992 | Hashimoto | 215/1 |
| 5,199,633 | A * | 4/1993 | Jantzen et al. | 229/103.1 |
| D360,558 | S | 7/1995 | Appleman | D7/507 |
| 5,439,125 | A | 8/1995 | Bloch | 215/229 |
| 5,460,264 | A | 10/1995 | Rupert | 206/217 |
| 5,477,978 | A | 12/1995 | Lo | 220/710 |
| 5,570,863 | A | 11/1996 | Cooper | 248/146 |
| 6,336,566 | B1 | 1/2002 | Lipson | |

* cited by examiner

*Primary Examiner*—Stephen J. Castellano
(74) *Attorney, Agent, or Firm*—Gifford Krass Sprinkle Anderson & Citkowski

(57) ABSTRACT

A combination drinking container and straw and method of manufacture. The container has at least one straw retaining member molded into either the outer or inner surface of the container wall, or a portion of the wall may be shaped to include a constricted stem. A malleable straw is fitted onto each such retaining member so that at least a portion of the pathway of the straw is defined by the retaining members. A first end of the straw extends into the container and a second end extends upwardly so that beverage may be sipped therefrom. A lid may close the container, the lid optionally including an aperture to permit passage of the straw, the straw passing through the aperture. Also disclosed is a lidded container wherein the lid is provided with an aperture. A first portion of a drinking straw extends from inside the container, through the hole and to the container's outside to form a hinge for the lid. A second portion of the straw is attached to the container. In this way, the lid remains attached to the straw and container even when removed from the container.

2 Claims, 8 Drawing Sheets

DRINK CONTAINER WITH MOLDED STRAW AND METHOD OF MANUFACTURE

REFERENCE TO RELATED APPLICATIONS

This application is a continuation of U.S. patent application Ser. No. 10/022,755 filed Dec. 13, 2001 now U.S. Pat. No. 7,021,490, which is a continuation of U.S. patent application Ser. No. 09/431,492 filed Nov. 2, 1999, now U.S. Pat. No. 6,336,566, which claims priority of U.S. Provisional Applications Ser. Nos. 60/107,419 filed Nov. 6, 1998 and 60/119,875 filed Feb. 12, 1999.

FIELD OF THE INVENTION

This invention relates to containers for liquids to be drunk from, and, more particularly, to such a drinking container equipped with a built-in drinking straw.

BACKGROUND OF THE INVENTION

It is known in the prior art to combine the concept of a drinking container and a drinking straw into one convenient device. Moreover, it is also known to provide the straw in the form of a tube which is wrapped around the container. Such combinations are depicted in U.S. Pat. No. 4,428,490 (FIG. 7), as well as U.S. Design Pat. Nos. 279,250 and 360,558. In these three designs, the straw is shown wrapped around the outside of the drinking container. There are also prior art designs involving a spiral straw and drink container wherein the straw is provided in some other relationship to the container. For example, U.S. Pat. No. 4,191,302 shows a spiral tube provided as the base of the container, with the container vessel mounted on top of it. U.S. Pat. No. 5,439,125 shows a container with a spiral drinking tube disposed inside the container. In addition, U.S. Pat. No. 5,570,863 shows a holder for supporting a drink container in the form of a spiral tube with an extension at the bottom which is meant to be inserted into the ground. This design, of course, does not actually show a drinking straw.

All of the above designs suffer from certain disadvantages. In particular, the two design patents, as well as the design shown in U.S. Pat. No. 4,428,490 all show the drinking straw or tube spirally wound around an outside surface of the container which is smooth. That is, the drinking tube and the wall of the container do not co-act in any way. In other words, the tube is not mounted securely with respect to the container, but is simply loosely wound around it. With such an arrangement, it is highly unlikely that the straw will be able to maintain any kind of fixed position with relation to the drink container.

Furthermore, these designs are somewhat lacking aesthetic appeal. The straw appears to be something simply added onto the container, and not integrally designed therewith. Thus, when such a prior art combination is grasped by the user, the hand encounters the straw, rather than the container wall. This also makes the container difficult to grasp.

It would be desirable to provide a combination drinking container and drinking straw in which the straw is attached to the container in a secure, semi-permanent manner.

It would be also desirable to provide such a combination which presents an aesthetically pleasing, integrated, and easy-to-use design.

SUMMARY OF THE INVENTION

The present invention is designed to overcome the shortcomings in the prior art noted above. It is a combination drinking container in the form of a bottle and straw and method of manufacture. The bottle includes a wall, a defining chamber, a bottom, and an open top. A lip may be one embodiment formed on an upper edge of the outer wall proximate the open top of the bottle for insertion of a cap thereon. The cap and lip, preferably, include mating grooves formed thereon so that the cap may be screwed onto the top.

The bottle is molded from an easily moldable plastic such as polyethylene and has at least one straw retaining member disposed on either an outside or inside surface thereof, or alternatively, formed by shaping the wall so that it includes a constricted portion, such as a stem. The straw retaining member is configured to retain a portion of hollow drinking straw which is inserted therein and the path of the straw around the bottle is defined by the path of the various retaining members. A first end of the straw forms a continuous drinking passage with the container chamber, either by extending into the chamber, or by being in fluid communication therewith by means of an aperture formed in the container wall, the straw first end being attached thereto.

In one embodiment, the cap, if included, has an aperture formed therein through which the first end of the straw may be inserted. It should be noted that the cap may be secured onto and off of the bottle without removing the straw, the upper portion of the straw serving as a "hinge" in this embodiment. In a further refinement of the concept, the straw may be formed with an elongated loop to serve as the "hinge," and also to function as a carrying loop by which the bottle may conveniently be carried by inserting a finger or two therethrough. Alternatively, the first portion may extend directly through an aperture formed in the bottle wall, itself, either near the top or bottom of the bottle.

A second end of the straw extends upwardly and outwardly from the bottle so that it may be sipped by the user. The path traced between a middle portion of the straw between the first and second ends may take various configurations, or be separate straw segments and chambers connected together to form a continuous drinking passage. In one configuration, the retaining member may comprise a groove molded into the bottle. Preferably, the groove is molded to contain most of the straw. In this way, the bottle presents a smooth profile, with the straw flush to the outer surface. When a user grasps the combination container of the present invention, the hand encounters the smooth bottle wall, rather than a bumpy straw.

The first end of the straw may extend straight down the side of the bottle and then spiral around the bottle upwardly until it joins the second end. The loops of the spiral may be, themselves, configured in the form of waves to make the path of the liquid sipped through the straw more interesting. At certain points, the configuration of the straw's path will be determined by the configuration of the groove which is molded into the outside surface of the bottle.

In another embodiment, the molded groove may be formed in portions, rather than continuous. For example, diametrically opposed portions of the container may be left ungrooved for ease of molding.

In yet another embodiment, the straw retaining members may comprise bumps or knobs around which the straw is wrapped to trace the desired pathway. Alternatively, the members may be molded as "pinch points or holes." A retaining ring may be added to help hold the straw in place. The various types of straw retaining members may also be combined.

In yet another embodiment of the container of the present invention, the path of the straw may diverge from the surface of the bottle to form loops, knots, and handles.

The container body may also be configured in a variety of ways. For example, it may be shaped as a typical "sports bottle" to hold drinking water for those engaged in activities. It can be molded in novelty shapes, such as a pumpkin. It can be formed in the shape of a mug. In another embodiment, it can be formed as a stemmed glass such as a champagne flute. The mug and drinking glass embodiments typically do not include a lid. In these embodiments, the straw may include a loop engaging portion which is force fitted past the stem into the bottom of the container, thus retaining the straw in the container.

The combination bottle and straw of the present is formed in the following manner. First, the bottle is blow molded using a two part mold which closes around a continuous extrusion. The pattern of the straw retaining members is shaped into the mold. A parison is first formed, then the two parts of the mold closed over the parison, thereby sealing the bottom of the bottle. Air under high pressure is then injected into the parison to blow it out against the walls of the mold to form the final shape including the pattern of grooves, bumps, knobs, pinch points, or holes. The molded bottle is cooled sufficiently, the mold is opened and the bottle released.

The embodiment of the bottle having a continuous groove presents a special molding problem. In order to allow the bottle to be easily released from the mold when it is opened, the continuous groove has opposed straight and parallel sections that span the parting line (where the two halves of the mold join). If the groove sections were not straight along the parting line, the bottle would be stuck on the mold ("undercut" or "overhung" in molding terminology). Preferably, the bottle is molded from high density polyethylene.

To form the straw, a straight rod is extruded using standard pipe extrusion techniques. Preferably, the straw is formed of PETG. The straight tube is then reheated either in an oven or with an appropriately shaped heating element. The first top end of the straw is inserted into a hole either in the cap or in the bottle. The straw is then curved downward and around the bottle, winding it around the various grooves, bumps, knobs, holes and pinch points until the entire path pattern has been followed. The free end of the straw is then molded upward from the bottle with a slight curve to easily reach the consumer's mouth for sipping. Alternately, the straw is formed of a highly malleable material and simply inserted into the groove, thus omitting the heating step.

Alternatively, a very flexible unheated straw could be similarly wound around the bottle. Pinch points retaining rings or knots may serve as retaining members in this version, or the straw could be glued to the bottle for added security.

In an alternate embodiment of the bottle of the present invention, the first end of the straw is provided with a connector so that it may be attached to the main body of the straw proximate the lid of the bottle. In this way, the straw and lid may be easily removed from the bottle.

Similarly, it is understood that in all of the embodiments mentioned in this specification, that when the term "straw" is used, it refers not only to a simple tube, but to any hollow passageway that brings liquid from the inside of the container to the users mouth to form a drinking passage. This passageway could include multiple pieces connected together, flexible pieces, ridged pieces, pieces with ornamentation, pieces that are puffed out into shapes, or pieces that diverge and come back together or pieces with valves, etc., as well as any combination of these enumerated structures. In the depicted embodiments, a simple tube, flexible or ridged, is depicted for simplicity's sake.

In another alternative embodiment, the straw is molded integral with the container. Alternatively, the groove may be formed either partially or entirely on the inside of the container, with the straw inserts thereinto.

In most of the above mentioned embodiments, it is understood that the straw comprised of different sections connected together and the differential sections could be formed of either flexible or ridged plastic. Thus, the straw or its various sections could be "unwrapped" or unthreaded or unbent (or some combination) and removed from the container and then put back on again. If one or more sections of the straw are flexible and the container includes pinch points, part or all of the straw could trace a different path when placed back on the container by using only some or all of the pinch points in different combinations or sequences. The defining characteristic of this embodiment is that only certain pinch points may hold the straw in place.

Furthermore, in any above mentioned embodiments, one or more parts of the straw may move or be bent in different configurations while the remainder of the straw are confined by the surface of the container.

Any of the above mentioned containers can be filled with added products such as candy or trinkets to add value to the combined product, with the implied later use of the container as a drinking device. Once these added products are removed, then the user can fill the drinking container and use it as such.

BRIEF DESCRIPTION OF THE DRAWINGS

The following detailed description is best understood with reference to the following drawings in which.

DETAILED DESCRIPTION OF THE PREFERRED EMBODIMENTS

Figure 1:
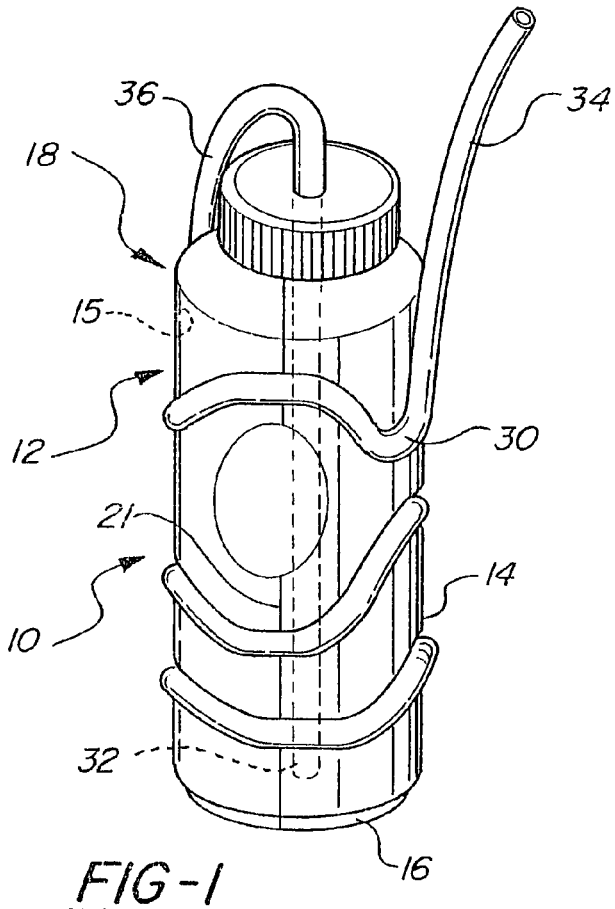
FIG. 1 is a perspective view of a combination bottle and straw constructed in accordance with the principles of the present invention.

Throughout the following detailed description, like reference numerals are used to refer to the elements of the present invention shown in multiple figures thereof. Referring now to the drawings, and in particular to FIG. 1, there is shown a combination drink container in the form of a sports bottle and straw 10. The combination includes a molded container 12 including a wall 14 defining a chamber 15, a bottom 16, and an open top 18. Molded into the outside surface 15 of wall 14 is a groove 20 configured to retain a drinking straw 30 therein. The groove retains most of the straw, thus giving the outside surface 15 a smooth, flush appearance.

Figure 2:
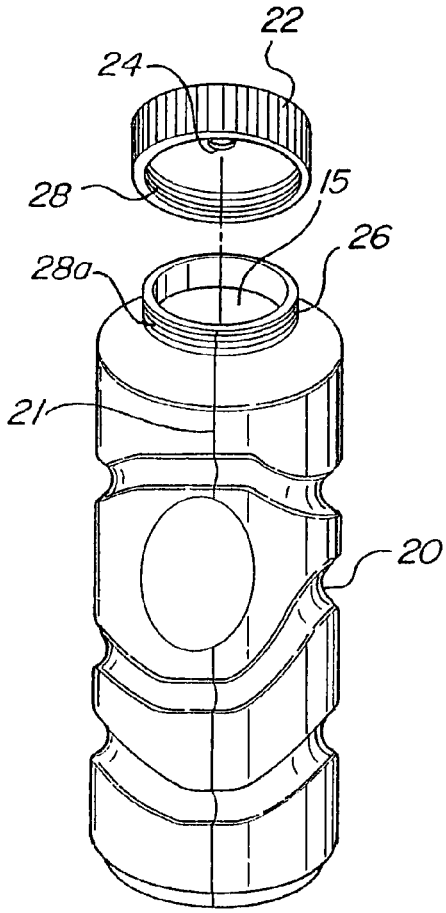
FIG. 2 shows the bottle of the present invention with the straw removed to better show the grooved outer wall.

Preferably, as can be seen in FIG. 2, the open top 18 of outside wall 14 terminates in a lip 26 configured to receive a cap 22. Lip 26 and cap 22 have mating grooves 28*a* and 28*b* formed thereon so that the cap 22 may be screwed on and off the container 12. An aperture 24 is formed in the center of lid 22 so that straw 30 may pass therethrough and down into the inside of the container 12.

The straw 30, which is in the form of a hollow tube, includes a first end 32 disposed in the inside of the container 12 proximate the bottom 16. The straw 30 extends up through the container 12 and out through the hole 24 in lid 22. The straw terminates in an upwardly and outwardly extending second end 34 so that beverage may be sipped through from container 12 by the user. A portion 36 of the straw 30 between first and second ends 32,34 is configured to wind around container 12. To that end, it is disposed inside groove 20. The exact configuration which the straw 12 takes will, thus, be determined by the configuration of groove 20. As can be seen in FIGS. 1 and 2, the groove 20 winds around the container 12 in spiral fashion, and also undulates in a wavy motion that leaves spaces for a design or other insignia to be printed on the container. However, it is to be understood that the groove 20 could be configured in a wide variety of designs, the depicted one being merely one possibility.

Figure 3:
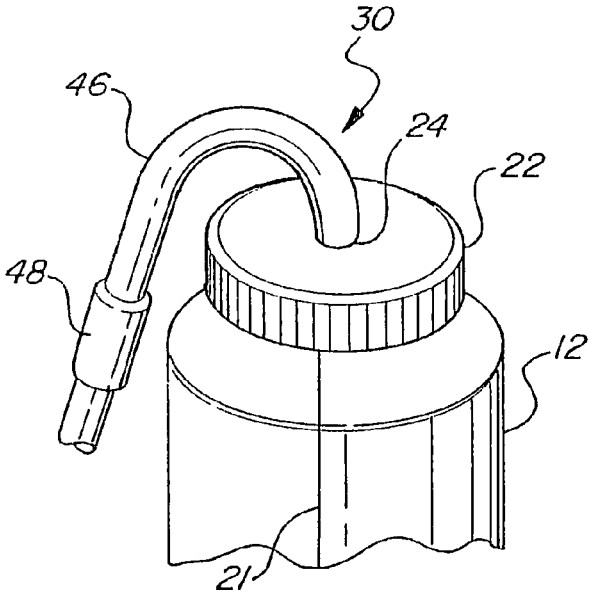
FIG. 3 is a detailed view of the top of the bottle and lid showing an alternate view of the straw construction provided with a connector for easy straw removal.

In an alternate embodiment of the straw 30 depicted in FIG. 3, the straw 30 includes a first portion 46 which extends into the inside of the container 12 through the hole 24 in lid 22. In this embodiment, portion 46 is separable from the remainder of the straw 30 and is attached thereto via connector 48. In this manner, the straw 30 and lid 22 may be more easily removed from the container. It is to be noted that the lid 22 may be unscrewed from the container 12 even when the straw 30 is fully installed onto the container in both depicted embodiments of the invention. In this way, straw 30 acts as a "hinge" for the lid 22.

The manner of manufacture of the sport bottle of FIGS. 1-3 will now be described. The container 12 is blow molded using standard processes from a material such as high density polyethylene. A two-part mold closes around a continuous extrusion or parison. The mold closes over the parison, sealing the bottom of the container. High pressure air is then injected into the parison to blow it out against the walls of the mold to form the final shape. The grooves which will be a prominent feature of the container of the present invention are formed directly by the mold. When the molded bottle has cooled sufficiently, the mold halves are opened and the bottle is released.

A blow molded plastic bottle necessarily has a seam running down the two sides where the two portions of the mold meet. This is called the parting line. A key design element of the present invention is the fact groove 20 has straight parallel sections in any location where the groove spans the parting line. This allows the bottle 12 to be easily removed from the mold when it opens. If the groove did not have straight, parallel sections in the area of the parting line, the bottle would be likely to remain struck on the mold (this is known as "undercut" or "overhang" in molding terminology). While a blow molded part made with complicated parting lines to allow for more complicated straw paths may be employed in practicing the method of the present invention, the two part, parallel separation is the most economical.

The drinking container could also be injection molded, but the container walls would have to be very thick to allow for the release of the inside part of the mold. Of course, all the extra plastic and mold costs would make it very costly to produce an injection molded product. Hence, the blow-molded embodiment is described in detail as the best and most economical way to produce the part.

To form the straw 30, a straight, hollow rod of PETG (a glycol-modified copolymer of polyester) is extruded using standard pipe extrusion techniques. The straight tube is then reheated, either in an oven or with an appropriately shaped heating element. The oven temperature is approximately 250°. The straw is removed from the heat when it is malleable. It is then inserted first into the hole 24 and cap 22. Then the straw 30 is curved downward to enter into groove 20 at the top 18 of the container 12. The straw 30 is molded into the groove 20 continuously until the entire path of groove 20 has been followed. The second end 36 of straw 30 is molded upward from the container with a slight curved to easily reach the consumer's mouth for sipping. It is contemplated that a jig or holder for the bottle could support the container while the straw is being bent and inserted into the grooves.

Alternatively, the straw 30 could be molded of a highly malleable polymer, in which case the heating step would be unnecessary. The straw 30 would simply be inserted into the groove 20.

Figure 4:
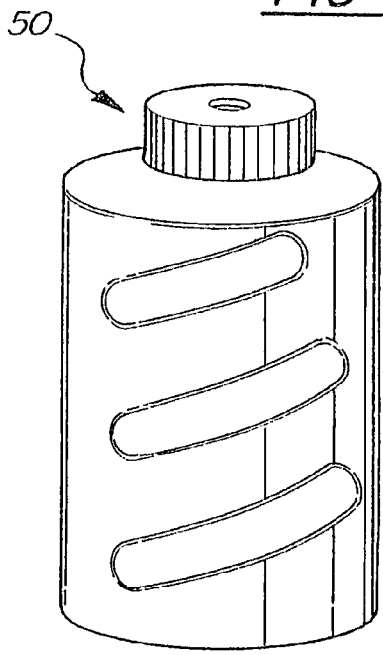
FIG. 4 shows another embodiment of the bottle with a non-continuous groove.

Other embodiments of the sport bottle of the present invention are illustrated in FIGS. 4 through 10. In particular, FIG. 4 illustrates another embodiment 50 in which the container is molded with a non-continuous groove. In this case, container 52 includes diametrically opposed portions 54 which do not contain any grooving. Due to this feature, the container 52 is relatively easy to mold and allows the straw to make a true spiral.

Figure 5A:
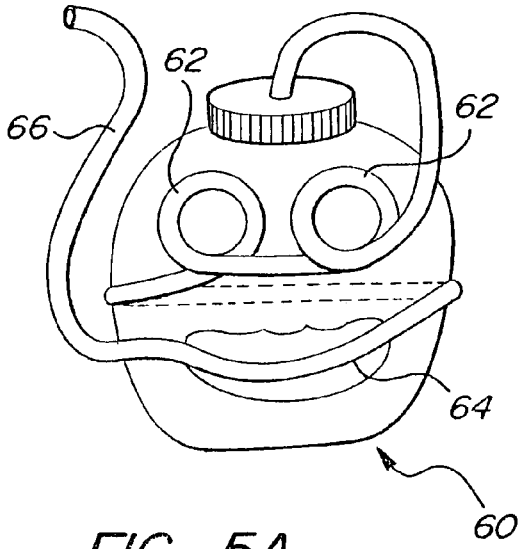
FIGS. 5*a* and 5*b* show an embodiment of the bottle with knobs and with the straw tracing different pathways around them.
Figure 5B:
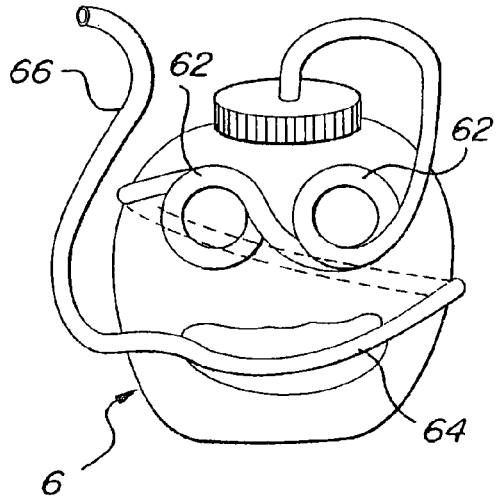

FIGS. 5*a* and 5*b* show yet further refinements 60 and 61 of a container according to the present invention in which the straw retaining members are in the form of bumps 62 and a short groove 64. In this case, the straw 66 can be installed onto the container so that the combination has the appearance of a smiley face. The respective FIGS. 5*a* and 5*b* illustrate how the same container 62 with the same elements 62,66 molded there into can be used to form straw paths of different designs. This kind of flexibility gives the container of the present invention a decided advantage in ease of manufacturing in that the same mold can be used to produce different sport bottles, or other types of containers, having markedly different designs simply by sequencing the straw through the various straw retaining members in different orders.

Figure 6:
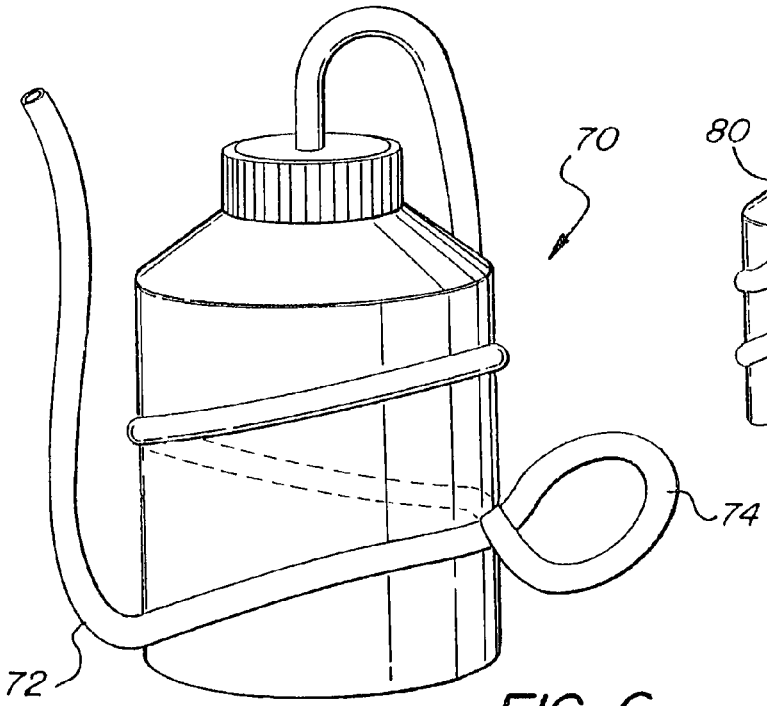
FIG. 6 shows another embodiment with the straw tracing a looped pathway that is off the surface of the container.

FIG. 6 shows yet another embodiment of a container 70 where the straw 72 traverses a path containing a loop 74 raised off of the surface of the container 70. If appropriately positioned and sized, loop 74 could serve as a handle.

Figure 7:
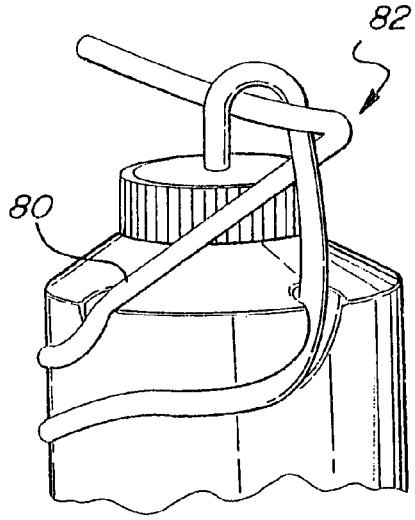
FIG. 7 is yet another embodiment in which the straw is formed with a knot.

FIG. 7 illustrates a similar concept in which the straw 80 forms a knot 82. This knot could be used to tie off back ends of the flexible tube in the groove so no retaining clips or rings are needed.

Figure 8:
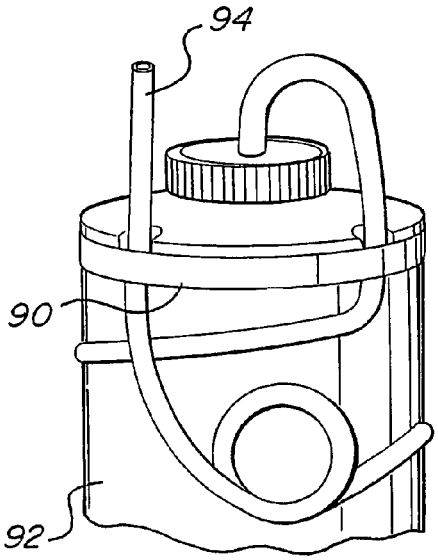
FIG. 8 is another embodiment in which a retaining ring helps secure the straw.

FIG. 8 illustrates yet another type of straw retaining member in the form of an attachment ring 90 which encircles the container 92 proximate an upper end thereof in order to more firmly retain a straw 94.

Figure 9:
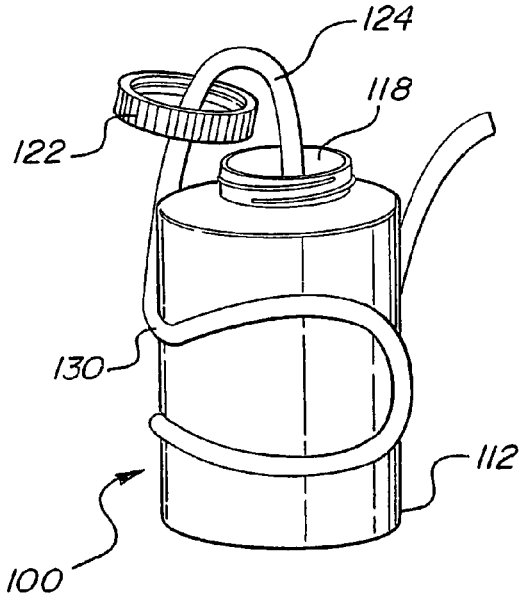
FIG. 9 is yet another embodiment with a portion of the straw thereof forming a combination hinge and carry loop.

FIG. 9 illustrates yet another important feature of the present invention. In this embodiment, the straw 130 is formed with an elongated loop 124 near the top 118. Loop 124 functions as a hinge to retain the lid 122 onto the sports bottle 100 even when the lid 122 is separated from the container 112, thus permitting "hands-free" operation when the user is otherwise engaged. Loop 124 also functions as a carrying loop so that the sports bottle may be conveniently carried by simply inserting a finger or two through the loop 124.

Figure 10A:
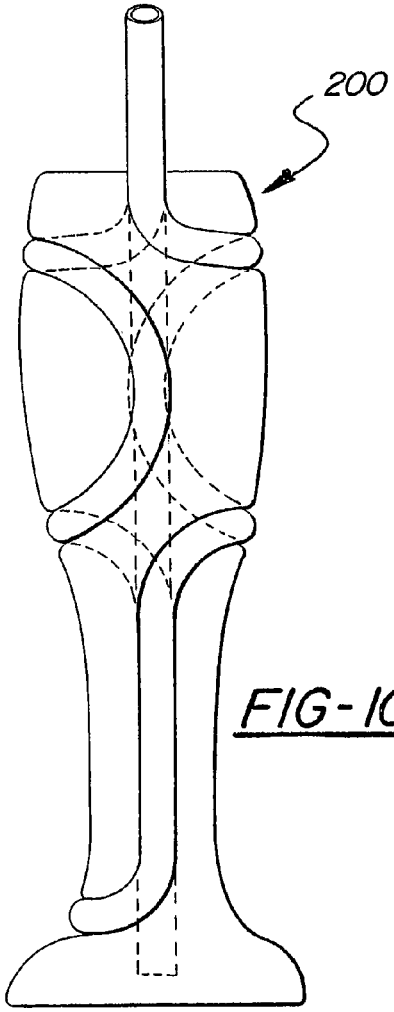
FIGS. 10*a*-10*f* show various designs of a drinking glass embodiment of the present invention.
Figure 10B:
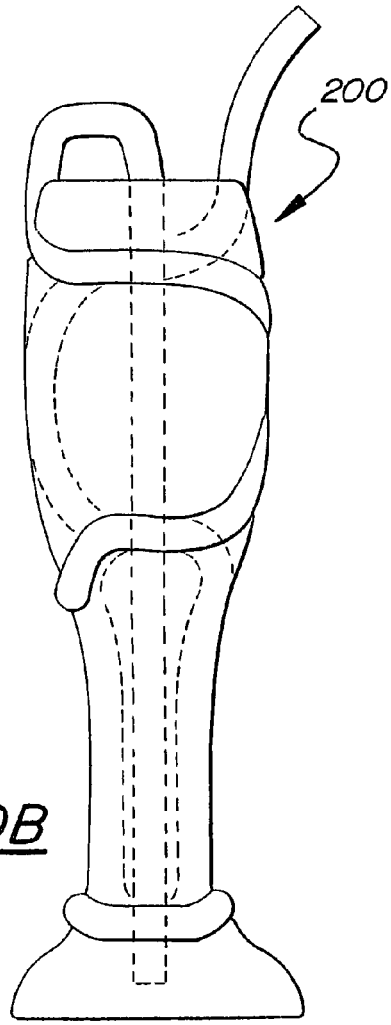

FIGS. 10*a*-10*b* show how the container of the present invention can be shaped as a drinking or stemmed glass. FIGS. 10*a* and 10*b* show a champagne flute 200, the flute of FIG. 10*b* being rotated 90° counterclockwise with respect to the FIG. 10*a* view.

Figure 10C:
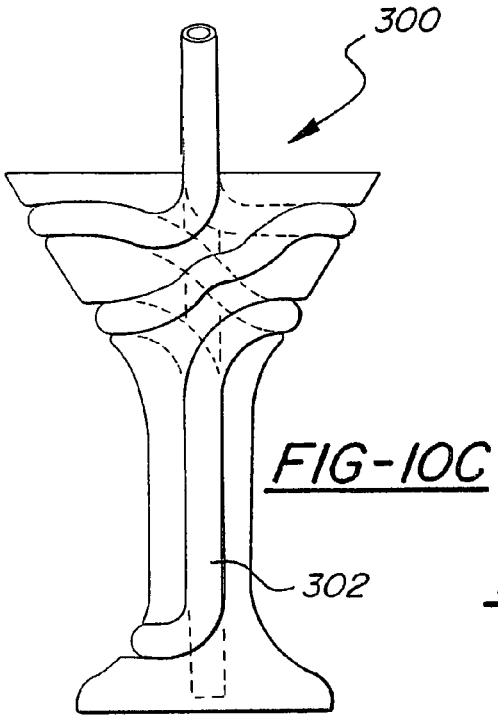
Figure 10D:
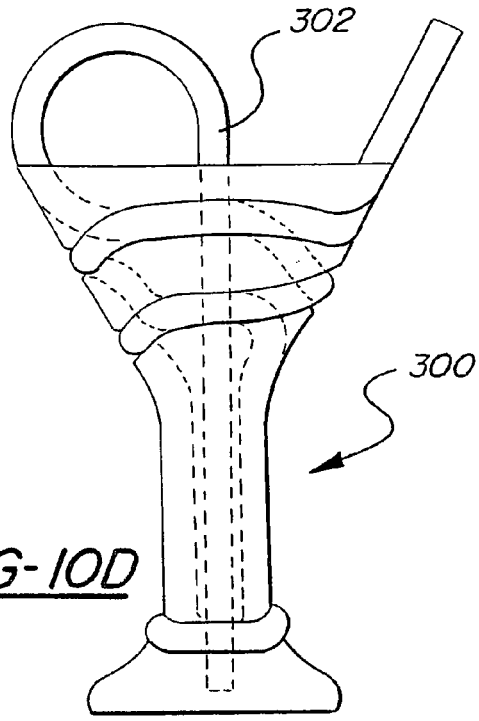

FIGS. 10*c* and 10*d* both depict a stemmed martini glass 300 with drinking straw 302 embedded therein, again with FIG. 10*d* rotated with respect to FIG. 10*c*.

Figure 10E:
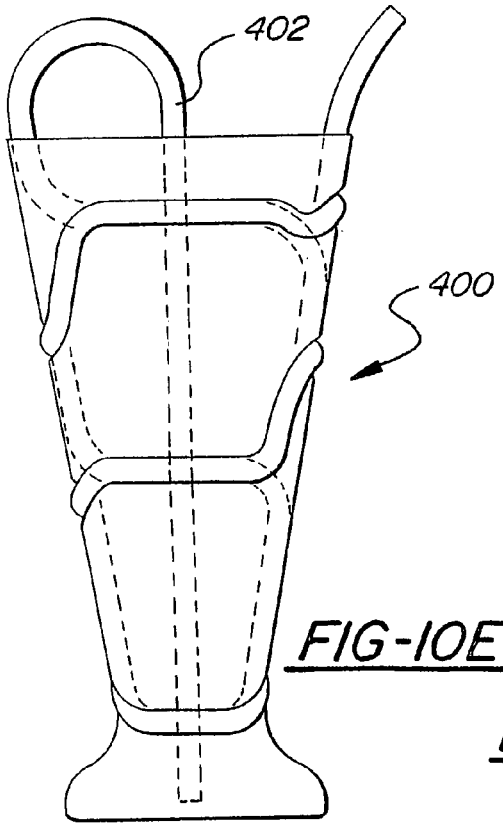
Figure 10F:
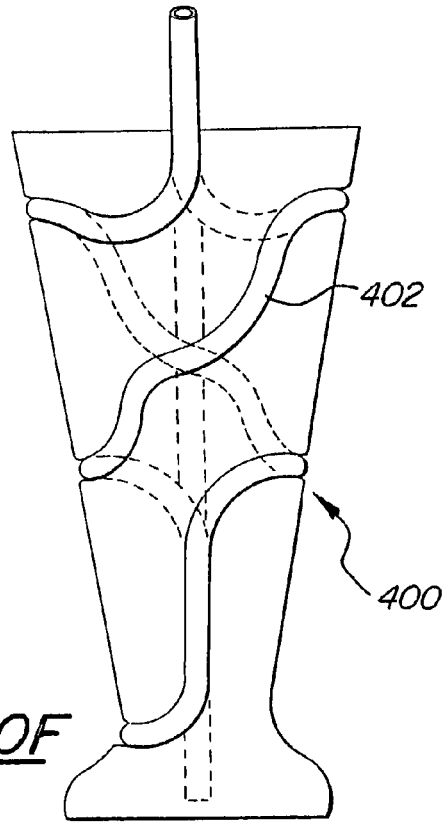

FIGS. 10*e* and 10*f* show a flared pilsner glass 400 with embedded straw 402, the FIG. 10*f* view again being rotated 90°. All of the FIG. 10*a*-10*c* views are particularly suitable for use in serving drinks at parties and other group situations and find great utility because of the appeal of the straw being constructed as part of the glass.

Figure 11A:
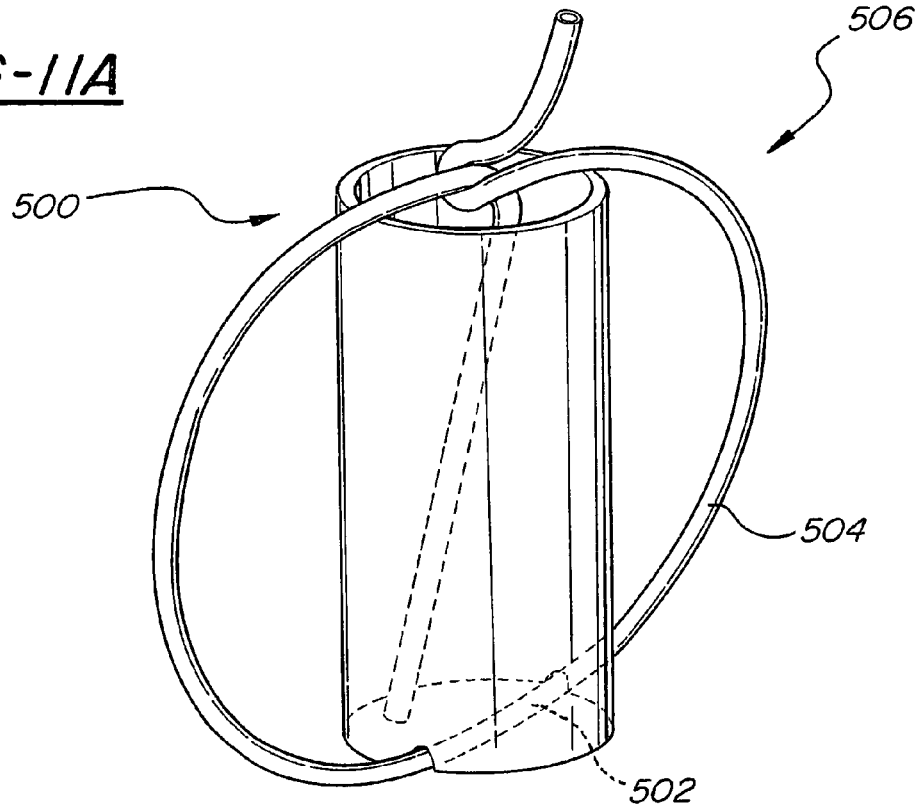
FIG. 11*a* shows a perspective view of yet another embodiment with a repositionable straw.
Figure 11B:
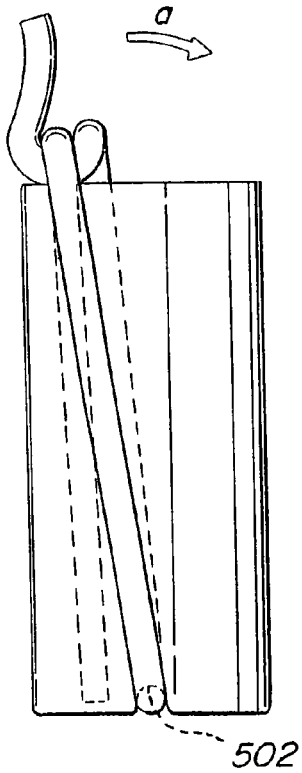
FIGS. 11*b* and 11*c* show the same embodiment of the invention, but with the straw in two different positions.
Figure 11C:
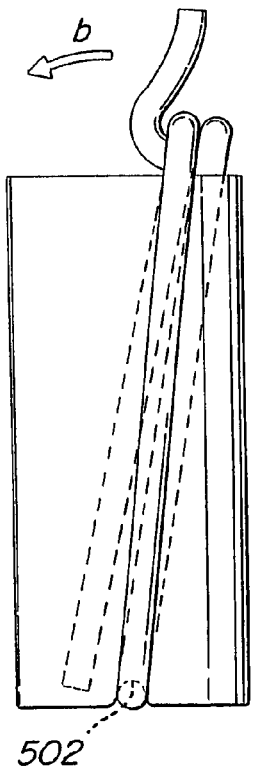

FIG. 11*a* shows a perspective view of another embodiment 500 of a drink container with a retaining groove 502 formed on the bottom of the glass. Rigid straw 504 is held in place by groove 502 but the top 506 of the straw is still free to move back and forth. FIGS. 11*b* and 11*c* show the same side view of this embodiment, but with the straw repositioned. In FIG. 11*b*, the straw is leaning to the left, but can move to the right as shown by arrow a. The embodiment would then look like FIG. 11*c* in which the straw could move back to its original position in a motion depicted by arrow b.

Figure 12B:
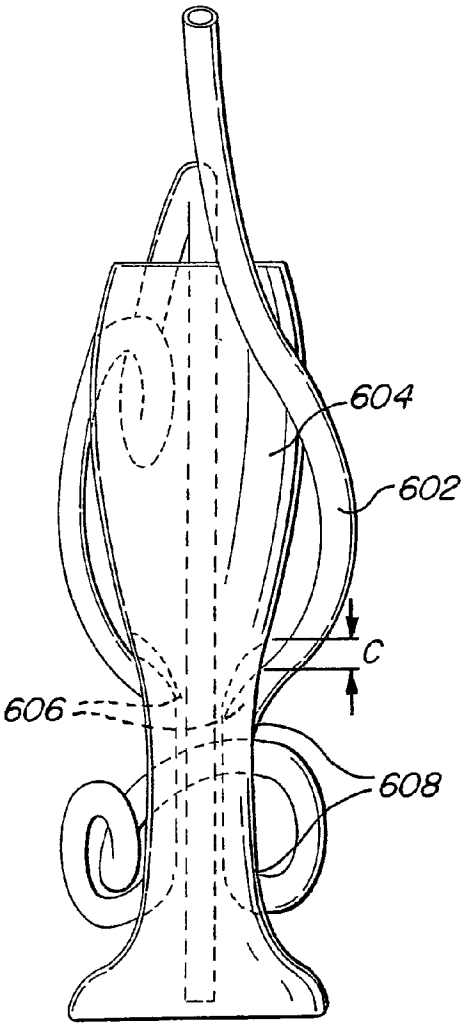
FIGS. 12*a* and 12*b* show two views of yet another embodiment wherein the straw is ridged and is attached only by gripping two slots.
Figure 12A:
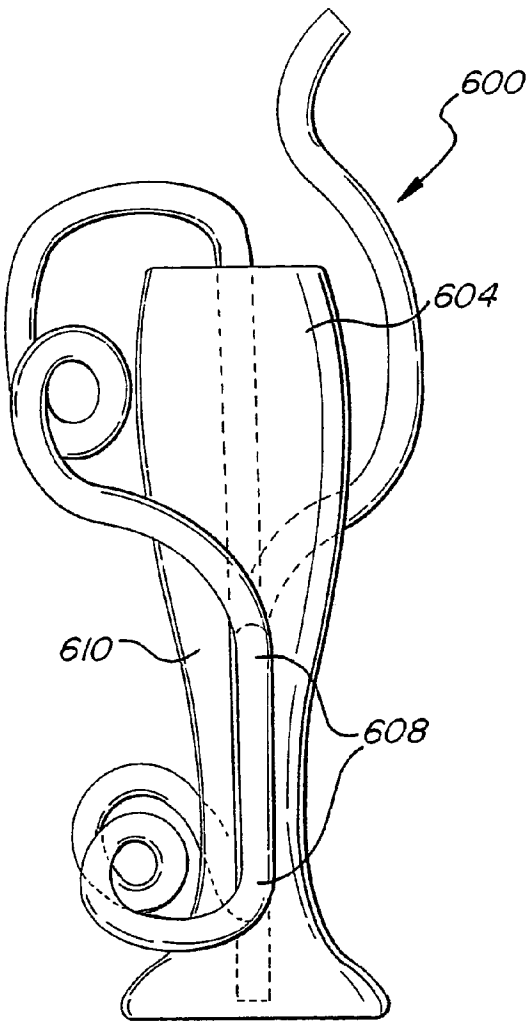

FIGS. 12*a* and 12*b* show two 90° rotated views of yet another embodiment 600. Rigid straw 602 is held on the container 604 by a pair of opposed slots 606. The straw has a restricted field of motion (depicted by the arrow c) as the straw slides up and down the slots 606. Area 608 provides a convenient place to hold this embodiment since straw 602 is easy to remove and place back on the container 604. In manufacturing this embodiment, it would be best to first mold the straw and then let it cool and then place it on the container.

Figure 13:
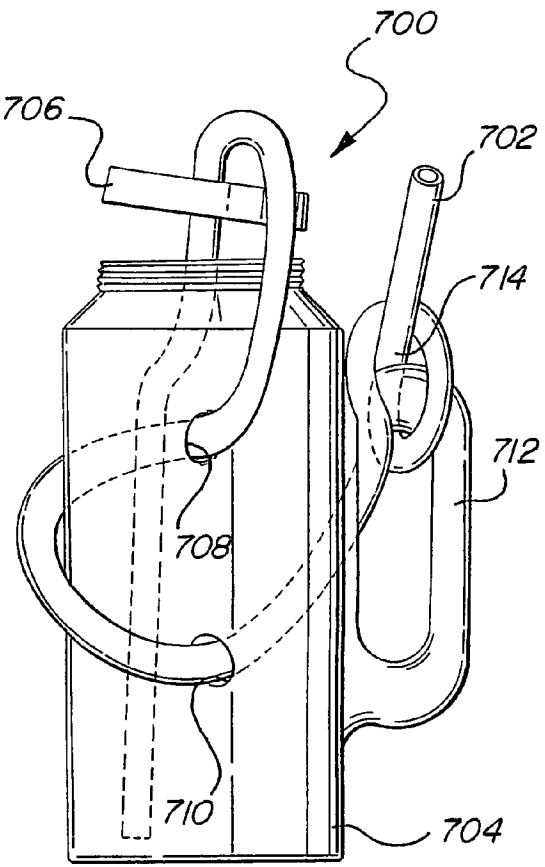
FIG. 13 shows yet another embodiment with a flexible straw retained on the outside of the container by threading it through holes that pass through the container.

FIG. 13 shows yet another embodiment 700 where the straw 702 could be formed of either rigid material after straw 702 rises through container 704 and passes through lid 706, it then passes first through bore 708, then through bore 710, and then through handle 712 twice. By passing through handle 712 twice in this manner, it creates a knot 714 which, if the straw is flexible, helps keep the straw in its configuration and attached to container 704.

Also it is important to note that both holes 708,710 are formed as tunnels which punch directly through the wall of container 704 at diametrically opposed points thereon to the other side. In this embodiment, if the straw is flexible, the contoured through bores and handle will help the straw stay in this shape, and if the straw is ridged the tunnels and handle will keep the straw attached to the container.

Figure 14:
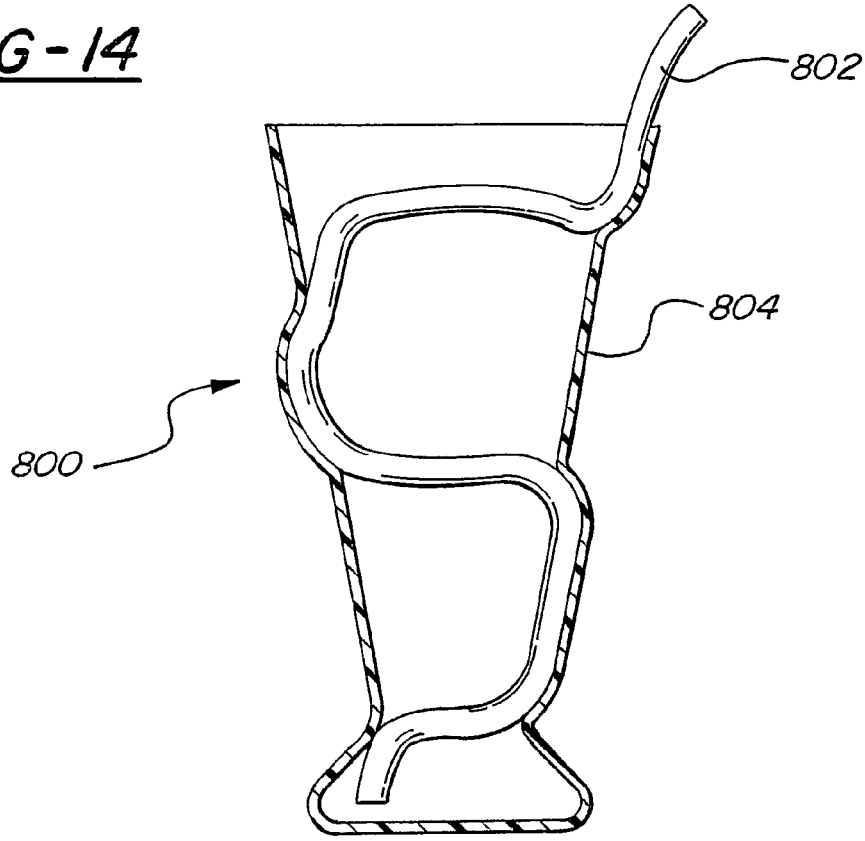
FIG. 14 shows still another embodiment with the groove formed on both the inside and outside of the container.
Figure 15:
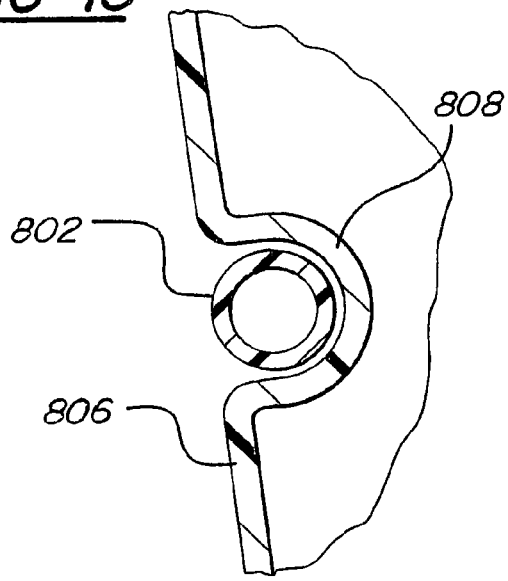
FIG. 15 is a detail, cross-sectional view of the embodiment of FIG. 14 showing how the groove is formed in the container wall.
Figure 16:
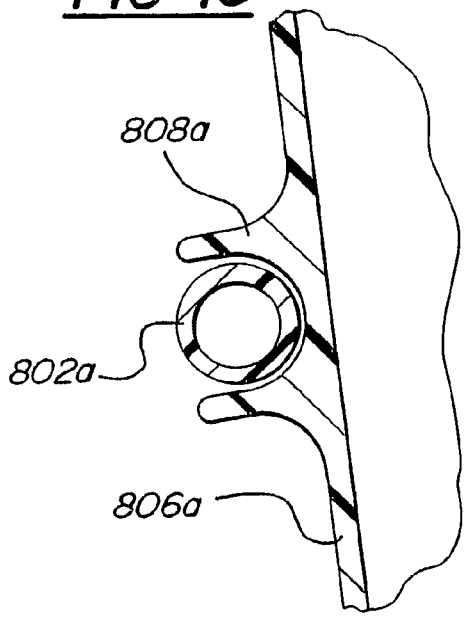
FIG. 16 is a detail view similar to FIG. 15 depicting a groove of different configuration.

FIG. 14 is yet another embodiment 800 of the combined container and straw of the present invention. A container 804 has a groove 806 molded on the inside surface 808 of the container 804. A straw 802 is disposed inside groove 808. In the depicted embodiment, the groove 808 has a "bumped out" profile on the outside of the container. However, by examining detail views 15 and 16, it should be possible to understand that the outer profile of the container need not appear bumpy from the groove. FIG. 15 shows a cross-section of the groove 808 depicted in FIG. 14 with straw 802 disposed inside. The "bump-out" of groove 808 is clearly visible. By molding groove 808 differently, as has been done in FIG. 16, a flush outer profile can be preserved even though straw 802*a* is similarly disposed on inner surface 806.

Figure 19:
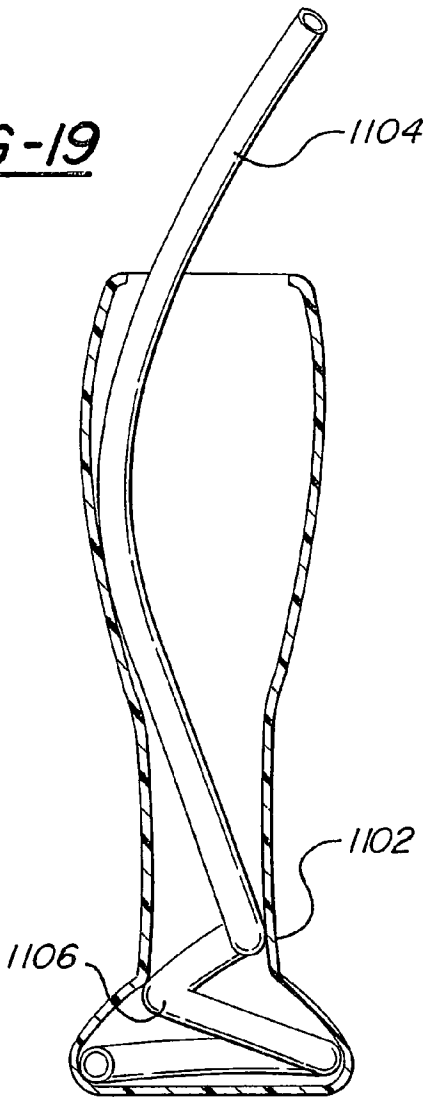
FIGS. 17-19 show various shaped containers formed with a narrowed stem to capture a looped portion of a straw therein.
Figure 18:
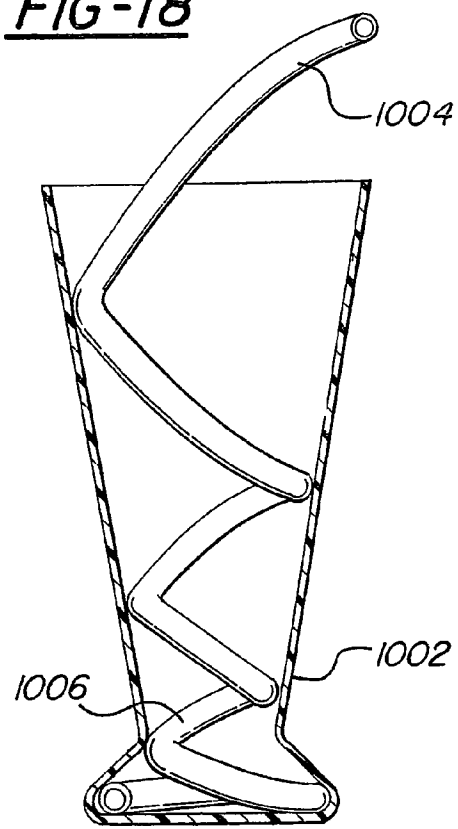
Figure 17:
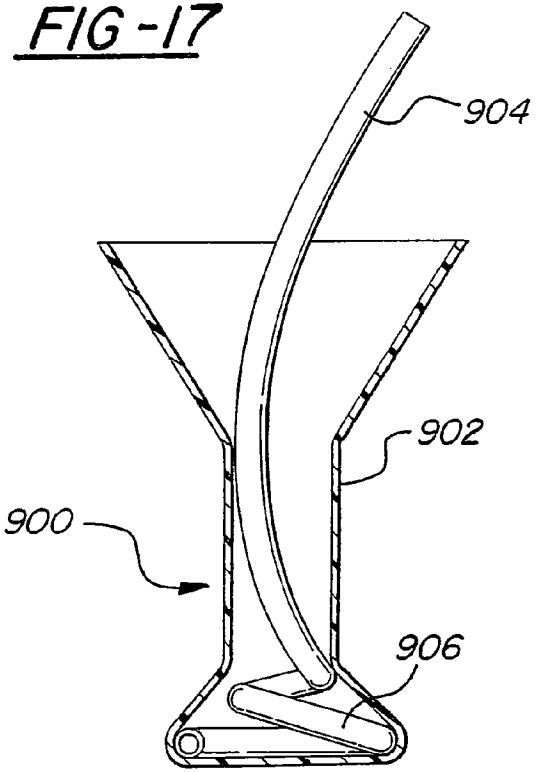

FIGS. 17-19 show yet further embodiments. The container 900 shown in FIG. 17 is configured with a constricted portion 902 (in the form of a stem). Straw 904 is formed to have a looped engaging portion 906 formed at one end thereof which is configured so that it cannot move past the constricted portion 904, thus retaining the straw in the container. FIGS. 18 and 19 show additional designs employing restricted portions 1002 and 1102 in combination with straws 1004 and 1104 which include corresponding engaging portions 1006 and 1106 configured appropriately. In FIGS. 17-19, the straw may rotate around but is semi-permanently attached to the container because it passed through the constricted portion and is larger on the bottom. In these embodiments, the container would preferably be clear so that the straw remains visible, and the straw would preferably be ridged because the retaining member (the constricted portion) cannot act to keep a flexible straw in its shape. The straw could be heat formed around an appropriate jig, cooled, and then pushed into the container. The spring action of the straw would coil in tightly and allow the straw to snap into the base.

Furthermore, due to the blow molding of the container and the perpendicular mold release of the mold in relation to the entrance to the top of the container, it is easy to produce lots of undercuts of this nature to have the straw grab and keep the straw retained in the container.

The combined container and straw of the present invention has numerous advantages over the prior art. The retaining members in the container allow for the straw to be custom molded to the surface of the container. The embodiment with the grooved design on the container has parallel sections at the center of the bottle to allow the blow mold to separate at the parting line and to release the bottle. The molding feature makes the straw and container a compact, single unit. The looped design of the straw at the top of the cap allows the cap to be slid up the straw sufficiently to fill the container from the cap without needing to remove the cap entirely from the container. Additional space between the grooves on both faces of the container allow placement of printed art and logos.

The distinctive shape of the straw of the present invention is an improvement over the common, "sport bottle," which only has a straw with no bends. The consumer gets enjoyment watching and feeling the liquid travel around the container. The design of the retainer members on the container allows it to be used as a mold to create the final straw shape. Furthermore, many variations of straw shape can be done with the retaining members so long as they are engineered properly for releasing the bottle from the mold.

These embodiments exemplify a novel co-mingling of a straw and the surface of a drinking container. For the embodiments depicting a straw formed of a flexible material, at some point the co-mingling of the container surface acts to hold the straw in its shape. On the other hand, if the straw is formed of a rigid material, then the co-mingling of the container surface acts to hold the straw to the container. Note that at different temperatures or if the straw is made up of different segments made of different materials, the straw might be both flexible and rigid at different points or at different times. Hence, both types of co-mingling could be involved.

A straw that is heated and bent around the contours of the container will use the container's surface to hold its shape. Once it cools and hardens, then the contours of the container's surface cease to help the straw hold its shape, but do help hold the straw to the container. Later, if washed at a high temperature such as in a dishwasher, the straw might once again become flexible, and once again the surface of the container would help the straw stay in its shape.

Furthermore, regardless of whether or not the straw is flexible, if it is at some point recessed into the wall of the container, it becomes desirable to look at and convenient to grasp the container at this point, especially if the straw is flush with the outside of the container. A user could firmly grasp this area of the straw and container at the same time and subtly feel the contours of both the straw and the container, but with an overall smooth effect.

This product can be manufactured in a number of ways. The container could be injection molded, roto molded, hand carved, hand casted, etc., but the economically preferred method of blow molding is described in detail. Likewise, the straw could be formed from the connection of numerous tubes and chambers of many types, all manufactured in various ways, but the most straight forward embodiment of a continuous tube is depicted in most of the embodiments. It is important to note that all methods and variations of methods and permutations of form are captured in the present invention.

What has been described herein is a combination container and straw for sipping liquids. The container is preferably blow molded and includes at least one straw retaining member formed in an inner or outer wall thereof. A malleable hollow straw is installed onto the retaining members so that the straw and container form a single unit. A first end of the straw extends into the container, and a second end extends upwardly from the container so that liquid may be sipped therefrom. The straw may pass through a lid having an aperture formed therein. Because of the looped designed of the straw at the top of the container in this embodiment, the lid may be opened from the container for filling without completely removing the lid from the container.

The herein invention has been described with reference to certain exemplifications and embodiments thereof. Doubtless, different variations and design may occur to one of skill in the art without departing from the spirit of the invention. Thus, it is claims appended hereto, as well as all reasonable equivalence thereof, rather than the exact depicted exemplifications and embodiments, which define the scope of the present invention.

The invention claimed is:

1. A combination drink container and straw, comprising:

a container having a sidewall and a connected flat bottom forming an open top chamber;

a groove formed in the center of the exterior of the bottom of the container, and extending between two separated points on the connection between the sidewall and the flat bottom; and a straw having a first end extending into and terminating in the chamber of the container, a second end extending and terminating exteriorly of the chamber so that liquid in the chamber may be sipped through the straw, the straw between the first and second ends extending through the groove on the exterior of the chamber, and at least a section of the straw extending in a loop spaced outwardly from the exterior of the sidewall between the first and second ends.

2. The combination drink container and straw of claim 1, wherein said loop forms a handle for said container.

* * * * *